US007054128B2

(12) United States Patent
Fuwa

(10) Patent No.: US 7,054,128 B2
(45) Date of Patent: May 30, 2006

(54) CONTROL APPARATUS FOR ELECTROMAGNETICALLY DRIVEN VALVE AND CONTROL METHOD OF THE SAME

(75) Inventor: Toshio Fuwa, Nissin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 304 days.

(21) Appl. No.: 10/449,017

(22) Filed: Jun. 2, 2003

(65) Prior Publication Data

US 2003/0235023 A1 Dec. 25, 2003

(30) Foreign Application Priority Data

Jun. 10, 2002 (JP) ..... 2002-169056

(51) Int. Cl.
*H01H 47/00* (2006.01)

(52) U.S. Cl. ..... 361/152

(58) Field of Classification Search ..... 361/152, 361/154, 187; 123/90.11
See application file for complete search history.

(56) References Cited

U.S. PATENT DOCUMENTS 5,539,608 A * 7/1996 Hurley et al. ..... 361/152
5,917,692 A * 6/1999 Schmitz et al. ..... 361/187
6,331,687 B1 * 12/2001 Dunk et al. ..... 218/140
6,373,678 B1 * 4/2002 Bartsch et al. ..... 361/160
6,390,039 B1 * 5/2002 Fuwa ..... 123/90.11
6,546,903 B1 * 4/2003 Taniguchi et al. ..... 123/90.11
6,588,385 B1 * 7/2003 Fuwa ..... 123/90.11
6,741,441 B1 * 5/2004 Hilbert et al. ..... 361/160

FOREIGN PATENT DOCUMENTS

JP 11-210916 A 8/1999

* cited by examiner

*Primary Examiner*—Ronald Leja
(74) *Attorney, Agent, or Firm*—Kenyon & Kenyon LLP

(57) ABSTRACT

A control apparatus for an electromagnetically driven valve is provided which is applied to an electromagnetically driven valve in which a movable portion including an armature and a valve element is driven using an electromagnetic force generated by an electromagnet. This control apparatus includes a controller. This controller performs feedback control such that a value of a current which is actually supplied to the electromagnet becomes substantially equal to a value of a desired attracting current when displacing the movable portion by supplying an attracting current to the electromagnet. Further, the controller variably sets a feedback gain used in feedback control of the attracting current, based on a distance between the electromagnet and the armature.

25 Claims, 6 Drawing Sheets

CONTROL APPARATUS FOR ELECTROMAGNETICALLY DRIVEN VALVE AND CONTROL METHOD OF THE SAME

INCORPORATION BY REFERENCE

The disclosure of Japanese Patent Application No. 2002-169056 filed on Jun. 10, 2002, including the specification, drawings and abstract is incorporated herein by reference in its entirety.

BACKGROUND OF THE INVENTION

1. Field of the Invention

The invention relates to a control apparatus for an electromagnetically driven valve which is applied to an electromagnetically driven valve in which a movable portion including an armature and a valve element is driven using an electromagnetic force generated by an electromagnet, and which controls a mode of driving the movable portion, and a control method of the same.

2. Description of Related Art

As a conventional control apparatus for an electromagnetically driven valve of this type, for example, a control apparatus disclosed in Japanese Patent Laid-Open Publication No. 11-21091 has been known. This control apparatus realizes both operation stability and quietness of the electromagnetically driven valve by controlling a command current value, which is a command value for controlling a supply of current to an electromagnet, to be large when a movable portion is apart from a displacement end, and by controlling a command current value to be small when the movable portion is close to the displacement end.

Namely, the control apparatus controls an armature to be attracted to the electromagnet with reliability by making the command current value large in the case where the movable portion is apart from the displacement end so as to ensure the operation stability of the electromagnetically driven valve. Meanwhile, the control apparatus decreases a contacting speed and the like when the armature contacts the electromagnet by making the command current value small in the case where the movable portion comes close to the displacement end so as to suppress a contacting sound generated when the armature contacts the electromagnet, and ensure the quietness of the electromagnetically driven valve.

Also, the control apparatus performs feedback control for controlling a value of a current which is actually supplied to the electromagnet to be substantially equal to the command current value. Also, the control apparatus aims both to ensure responsiveness and to suppress hunting by controlling a feedback gain of the attracting current which is supplied to the electromagnet when displacing the movable portion to be larger than a feedback gain of a holding current which is supplied to the electromagnetic when holding the movable portion, when performing the feedback control.

The conventional control apparatus controls the value of the feedback gain of the attracting current and the value of the feedback gain of the holding current to be different from each other. However, each of the feedback gain of the attracting current and the feedback gain of the holding current is a fixed value. Therefore, the following trouble cannot be ignored which occurs since the feedback gain is fixed especially when the feedback of the attracting current is performed.

Namely, the responsiveness (the current responsiveness) depends on coil inductance of the electromagnet, that is, a distance between the electromagnet and the armature.

Accordingly, when this feedback gain is controlled to be large so as to obtain excellent current responsiveness in a whole displacement area of the armature, hunting occurs in the attracting current in a certain displacement area of the armature. Meanwhile, when the feedback gain is controlled to be small so as to suppress such hunting in the whole displacement area of the armature, the current responsiveness deteriorates in a certain displacement area of the armature. Thus, it is difficult to perform appropriate feedback control of the attracting current in the whole displacement area of the armature, using the conventional apparatus.

SUMMARY OF THE INVENTION

The invention is made in order to solve such a problem. Accordingly, it is an object of the invention to provide a control apparatus for an electromagnetically driven valve and a control method of the same which can more appropriately perform feedback control of attracting current when an armature is attracted to an electromagnet in a whole displacement area of the armature.

According to an exemplary embodiment of the invention, a control apparatus for an electromagnetically driven valve is provided which is applied to an electromagnetically driven valve in which a movable portion including an armature and a valve element is driven using an electromagnetic force generated by an electromagnet. This control apparatus includes a controller. This controller performs feedback control such that a value of a current which is actually supplied to the electromagnet becomes substantially equal to a value of a desired attracting current, when displacing the movable portion by supplying an attracting current to the electromagnet. Then, the controller variably sets the feedback gain used in the feedback control of the attracting current based on a distance between the electromagnet and the armature.

According to a further exemplary embodiment of the invention, there is provided a control method for an electromagnetically driven valve in which a movable portion including an armature and a valve element is driven using an electromagnetic force generated by an electromagnet. This control method includes the steps of: performing feedback control such that a value of a current which is actually supplied to the electromagnet becomes substantially equal to a value of a desired attracting current when displacing the movable portion by supplying an attracting current to the electromagnet; and variably setting a feedback gain used in the feedback control of the attracting current based on a distance between the electromagnet and the armature.

According to the control apparatus having such a configuration and the control method thereof, it is possible to variably set a feedback gain used in feedback control of an attracting current based on a distance between an electromagnet and an armature. Accordingly, it is possible to set an appropriate feedback gain based on the distance between the electromagnet and the armature even when coil inductance of the electromagnet changes due to a change in the distance between the electromagnet and the armature. Therefore, it is possible to ensure excellent current responsiveness while suppressing hunting which has occurred in the attracting current at various distances between the electromagnet and the armature. Consequently, it is possible to more appropriately perform the feedback control of the attracting current when the armature is attracted to the electromagnet in the whole displacement area of the armature.

According to a further exemplary embodiment of the invention, a control apparatus for an electromagnetically driven valve is provided which is applied to an electromagnetically driven valve in which a movable portion including an armature and a valve element is driven using an electromagnetic force generated by an electromagnet, and this control apparatus includes a controller. This controller performs feedback control such that a value of a current which is actually supplied to the electromagnet becomes substantially equal to a value of a desired attracting current, when displacing the movable portion by applying a voltage to the electromagnet so as to supply an attracting current. Also, the controller variably sets a mode of applying a voltage to the electromagnet such that the value of the current which is actually supplied to the electromagnet comes close to the value of the desired attracting current, based on the distance between the electromagnet and the armature.

Also, according to a further exemplary embodiment of the invention, there is provided a control method for an electromagnetically driven valve which is applied to an electromagnetically driven valve in which a movable portion including an armature and a valve element is driven using an electromagnetic force generated by an electromagnet. This control method includes the following steps of: performing feedback control such that a value of a current which is actually supplied to the electromagnet becomes substantially equal to a value of a desired attracting current when displacing the movable portion by applying a voltage to the electromagnet so as to supply an attracting current; and variably setting a mode of applying a voltage to the electromagnet such that the value of the current that is actually supplied to the electromagnet comes close to the value of the desired attracting current, based on the distance between the electromagnet and the armature.

A transitional characteristic of the current which is actually supplied to the electromagnet due to the application of the voltage to the electromagnet changes based on the distance between the electromagnet and the armature. Accordingly, even when a voltage is applied to the electromagnet such that the value of the current which is actually supplied to the electromagnet becomes substantially equal to the value of the desired attracting current, the mode of supplying the current to the electromagnet depends on the distance between the electromagnet and the armature.

However, according to the above-mentioned control apparatus for an electromagnetically driven valve and the control method thereof, the mode of applying a voltage to the electromagnet is variably set such that the value of the current which is actually supplied to the electromagnet comes close to the value of the desired attracting current, based on the distance between the electromagnet and the armature. Accordingly, even when the transitional characteristic of the current which is actually supplied to the electromagnet due to the application of the voltage to the electromagnet changes according to a change in the distance between the electromagnet and the armature, it is possible to appropriately control the mode of supplying the current to the electromagnet regardless of a change in the transitional characteristic. Therefore, according to the above-mentioned configuration, it is possible to more appropriately perform feedback control of the attracting current when the armature is attracted to the electromagnet in a whole displacement area of the armature.

According to a further exemplary embodiment of the invention, a control apparatus for an electromagnetically driven valve is provided which is applied to an electromagnetically driven valve in which a movable portion including an armature and a valve element is driven using an electromagnetic force generated by an electromagnet, and the control apparatus includes a controller. Namely, this controller performs feedback control such that a value of a current which is actually supplied to the electromagnet becomes substantially equal to a value of a desired attracting current when displacing the movable portion by supplying an attracting current to the electromagnet. Also the controller dynamically changes a control mode of the feedback control based on a distance between the electromagnet and the armature.

According to a further exemplary embodiment of the invention, there is provided a control method for an electromagnetically driven valve which is applied to an electromagnetically driven valve in which the movable portion including an armature and a valve element is driven using an electromagnetic force generated by an electromagnet. This control method includes the following steps of: performing feedback control such that a value of a current which is actually supplied to the electromagnet becomes substantially equal to a value of a desired attracting current when displacing the movable portion by supplying an attracting current to the electromagnet; and dynamically changing a control mode of the feedback control based on a distance between the electromagnet and the armature.

Coil inductance of the electromagnet changes based on the distance between the electromagnet and the armature. Accordingly, when the feedback control is performed such that the value of the current which is actually supplied to the electromagnet becomes substantially equal to the value of the desired attracting current, a response mode of the current which is actually supplied to the electromagnet with respect to the feedback control depends on the distance between the electromagnet and the armature.

However, according to the control apparatus for an electromagnetically driven valve and the control method thereof, the control mode of the feedback control is dynamically changed based on the distance between the electromagnet and the armature. Accordingly, it is possible to perform feedback control considering that the response mode of the current which is actually supplied to the electromagnet with respect to the feedback control depends on the distance between the electromagnet and the armature. Therefore, according to the above-mentioned configuration, it is possible to more appropriately perform feedback control of the attracting current when the armature is attracted to the electromagnet in the whole displacement area of the armature.

BRIEF DESCRIPTION OF THE DRAWINGS

The above-mentioned embodiment and other embodiments, objects, features, advantages, technical and industrial significances of the invention will be better understood by reading the following detailed description of the exemplary embodiments of the invention, when considered in connection with the accompanying drawings, in which.

DESCRIPTION OF THE EXEMPLARY EMBODIMENT

In the following description and the accompanying drawings, the present invention will be described in more detail in terms of exemplary embodiments.

Hereafter, an embodiment will be described in which a control apparatus for an electromagnetically driven valve according to the invention is applied to a control apparatus which opens or closes a valve element that functions as an intake valve or an exhaust valve of an internal combustion engine.

In the embodiment, each of the intake valve and the exhaust valve is configured as an electromagnetically driven valve that is opened or closed by an electromagnetic force generated by an electromagnet. Since these intake valve and the exhaust valve have the same configuration and the same driving control mode, hereafter, the exhaust valve will be described as an example.

Figure 1:
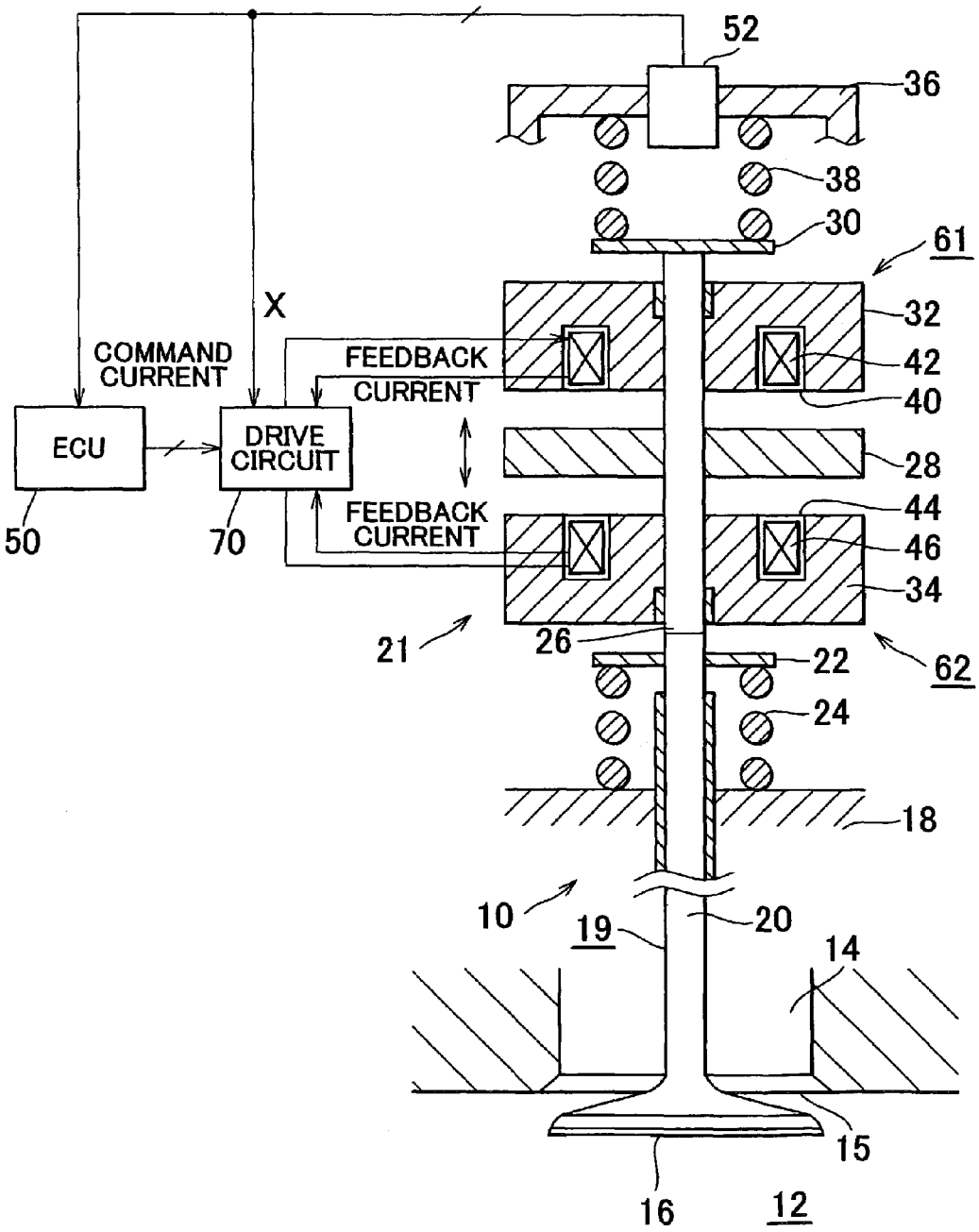
FIG. 1 is a sectional view showing a configuration of an embodiment of a control apparatus for an electromagnetically driven valve according to the invention.

As shown in FIG. 1, an exhaust valve 10 includes the following components. More particularly, the exhaust valve 10 includes a valve element 19 which is formed of a valve shaft 20 that is supported by a cylinder head 18 so as to be capable of reciprocating, an armature shaft 26 that is provided coaxially with the valve shaft 20 and that reciprocates together with the valve shaft 20, and an umbrella portion 16 that is provided on one end of the valve shaft 20, and an electromagnetically drive portion 21 which drives the valve element 19 such that the valve element 19 reciprocates.

An exhaust port 14 which communicates with a combustion chamber 12 is formed in a cylinder head 18, and a valve seat 15 is formed on a periphery of an opening of the exhaust port 14. The exhaust port 14 is opened or closed when the umbrella portion 16 is seated on or separated from the valve seat 15 in accordance with the reciprocation of the valve shaft 20.

In the valve shaft 20, a lower retainer 22 is fixed to an end portion which is on an opposite side of the end portion in which the umbrella portion 16 is provided. A lower spring 24 is provided in a compressed state between the lower retainer 22 and the cylinder head 18. The valve element 19 is urged in a valve closing direction (upper direction in FIG. 1) using an elastic force of the lower spring 24.

A discform armature 28 formed of high permeable material is fixed on a substantially center portion in an axial direction of the armature shaft 26, and an upper retainer 30 is fixed to one end of the armature shaft 26. The end portion on the opposite side of the end portion to which this upper retainer 30 is fixed in the armature shaft 26 contacts the end portion of the valve shaft 20 on the side of the lower retainer 22.

An upper core 32 is fixed between the upper retainer 30 and the armature 28 in a casing (not shown) of the electromagnetically drive portion 21. Also, a low core 34 is fixed between the armature 28 and the lower retainer 22 in this casing. Both the upper core 32 and the lower core 34 are formed in a ring shape using high permeable material, and the armature shaft 26 is inserted in central portions of the upper core 32 and the lower core 34 so as to be capable of reciprocating.

An upper spring 38 is provided in a compressed state between the upper cap 36 and the upper retainer 30, which are provided in the casing. The valve element 19 is urged in a valve opening direction (lower direction in FIG. 1) using an elastic force of the upper spring 38.

A displacement amount sensor 52 is attached to the upper cap 36. This displacement amount sensor 52 outputs a voltage signal which changes based on the distance between the displacement sensor 52 and the upper retain 30. Accordingly, it is possible to detect a displacement amount of the armature shaft 26 and the valve shaft 20, that is, a displacement amount of the valve element 19 based on this voltage signal.

A ring-shaped groove 40 whose center is a shaft center of the armature 26 is formed on a surface of the upper core 32, which faces the armature 28, and a ring-shaped upper coil 42 is provided in the groove 40. An electromagnet (an electromagnet for driving a valve closed) 61 for driving the valve element 19 in a valve closing direction (hereinafter, simply referred to as an "electromagnet 61") is formed of the upper coil 42 and the upper core 32.

Meanwhile, a ring-shaped groove 44 whose center is the shaft center of the armature shaft 26 is formed on a surface facing the armature 28 in the lower core 34, and a ring-shaped lower coil 46 is provided in the groove 44. An electromagnet (an electromagnet for driving a valve opened) 62 for driving the valve element 19 in a valve opening direction (hereinafter, simply referred to as an "electromagnet 62") is formed of the lower coil 46 and the lower core 34.

An electronic control unit (ECU) 50 which performs various control of the internal combustion engine via a drive circuit 70 controls the supply of current to the coil 42 of the electromagnet 61 and the coil 46 of the electromagnet 62. This electronic control unit 50 includes an input circuit (not shown) which takes in a signal detected by the displacement amount sensor 52, an A/D converter (not shown) which performs analog-digital conversion of this detected signal and the like in addition to a central processor and memory.

FIG. 1 shows a state of the valve element 19 when a current (an attracting current) is supplied neither to the electromagnet 61 nor the electromagnet 62, and an electromagnetic force is not generated in these electromagnets 61, 62. In this state, the armature 28 is not attracted by the electromagnetic force of the electromagnets 61, 62, and stops at an intermediate position between the cores 32 and 34 at which the urging force of the spring 24 is substantially equal to the urging force of the spring 38. In this state, the umbrella portion 16 is separated from the valve seat 15, and the exhaust valve 10 is in a half-opened state. Hereinafter, the position of the valve element 19 in this state will be referred to as a neutral position.

Next, an operation mode of the exhaust valve 10 which is opened or closed controlling current supply to the electromagnet 61 and the electromagnet 62. A holding current for maintaining the exhaust valve 10 in a fully opened state is supplied to the electromagnet 61 when the exhaust valve 10 is maintained in the fully opened state. Due to the supply of the holding current, the armature 28 is attracted by the electromagnetic force generated by the electromagnet 61 and contacts the upper core 32 resisting the elastic force of the upper spring 38, and the umbrella portion 16 is kept seated on the valve seat 15.

Next, when the exhaust valve 10 needs to be opened, control of current supply to the electromagnet 61 is performed during a period from when it becomes necessary to open the exhaust valve 10 until when the valve element 19 reaches a position which is on a valve closing side with respect to the neutral position by a predetermined amount. During this period, the armature 28 is separated from the upper core 32 and the valve element 19 is displaced in the valve opening direction. Also, the electromagnetic force for attracting the valve element 19 (the armature 28) in a valve closing direction is controlled through adjustment of the driving current supplied to the electromagnet 61 such that the displacement speed does not become too high due to an external force based on a pressure in a cylinder or an exhaust pressure.

When the valve element 19 is displaced from the fully closed position by a predetermined amount, the supply of the driving current to the electromagnet 61 and the electromagnet 62 is stopped during a period from when the valve element 19 is displaced from the fully closed position until when the valve element 19 reaches a position which is on a valve opening side with respect to the neutral position by a predetermined amount.

Then, when the valve element 19 is further displaced due to an elastic force of the upper spring 38 or the like and reaches the position which is on a valve opening side with respect to the neutral position by a predetermined amount, the control of current supply to the electromagnet 62 is performed during a period from when the valve element reaches this position until when the valve element 19 reaches the fully opened position. During this period, the electromagnetic force for attracting the valve element 19 in a valve opening direction is controlled through adjustment of the attracting current supplied to the electromagnet 62 such that the valve element 19 reliably reaches the fully opened position at a predetermined displacement speed.

When the valve element 19 reaches the fully opened position, a holding current for maintaining the exhaust valve 10 in the fully opened state is supplied to the electromagnet 62 during a period from when the valve element reaches the fully opened position until when a predetermined time elapses. Since this holding current is supplied, the armature 28 is attracted due to the electromagnetic force generated by the electromagnet 62 and contacts the lower core 34 resisting the elastic force of the lower spring 24, and a state is maintained in which the distance between the umbrella portion 16 and the valve seat 15 is the largest.

Next, when a predetermined time has elapsed since the valve element 19 reaches the fully opened position, the control of current supply to the electromagnet 62 is performed during a period from when the valve element 19 reaches the fully opened position until when the valve element 19 reaches a position on the valve opening side with respect to the neutral position by a predetermined amount. During this period, the armature 28 is separated from the lower core 34 and the valve element 19 is displaced in a valve closing direction. Also, the electromagnetic force for attracting the valve element 19 in a valve opening direction is controlled through adjustment of the attracting current supplied to the electromagnet 62 such that the displacement speed does not become too high due to an external force based on a pressure in a cylinder or an exhaust pressure.

When the valve element 19 is displaced from the fully opened position by a predetermined amount, the supply of the driving current to the electromagnet 61 and the electromagnet 62 is stopped during a period from when the valve element 19 is displaced until when the valve element 19 reaches a position on a valve closing side with respect to the neutral position by a predetermined amount.

Then, when the valve element 19 is further displaced due to the elastic force of the lower spring 24 or the like and reaches the position on the valve closing side with respect to the neutral position by a predetermined amount, the control of current supply to the electromagnet 61 is performed during a period from when the valve element 19 reaches the above-mentioned position until when the valve element 19 reaches the fully closed position. During this period, the electromagnetic force for attracting the valve element 19 in a valve closing direction is controlled through adjustment of the attracting current supplied to the electromagnet 61 such that the valve element 19 reliably reaches the fully closed position at a predetermined displacement speed.

When the valve element 19 reaches the fully closed position, the holding current for maintaining the exhaust valve 10 in the fully closed state is re-supplied to the electromagnet 61 during a period from when the valve element 19 reaches the fully closed position until when the valve element 19 needs to be opened.

Figure 2:
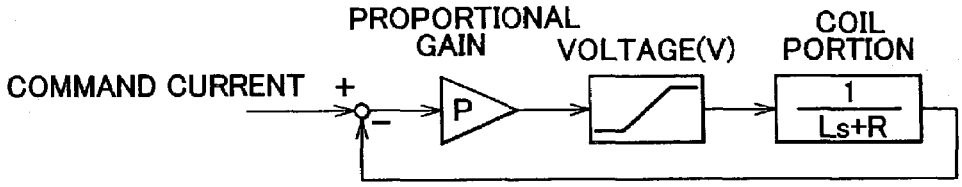
FIG. 2 is a block diagram describing feedback control in the embodiment.

As described so far, according to the embodiment, the movable portion including the valve element 19 and the armature 28 is displaced by supplying the attracting current to the electromagnet 61 and the electromagnet 62. This is performed when the electronic control unit 50 calculates, based on displacement amounts of the valve element 19 and the armature 28, a command current value as a value of the desired attracting current, which is used in the control of current supply to the electromagnet 61 and the electromagnet 62. In this case, feedback control using the drive circuit 70 is performed such that the value of the current which is actually supplied to the electromagnet 61 and the electromagnet 62 becomes substantially equal to the command current value. FIG. 2 describes the feedback control using this drive circuit 70.

In FIG. 2, a coil portion shows a transfer function between the coil 42 of the electromagnet 61 and the coil 46 of the electromagnet 62 and the armature 28. L denotes inductance between the coils 42, 46 and the armature 28, and R denotes resistance of the coils 42, 46. As shown in FIG. 2, in the embodiment, P (proportional) control is performed as feedback control. Namely, a current, which is proportional to a deviation between the command current value supplied from the electronic control unit 50 and the value of the current that is actually supplied to the coil 42 of the electromagnet 61 and the coil 46 of the electromagnet 62, is supplied to the coils 42, 46.

More particularly, this is performed by applying voltage to the coils 42, 46. This voltage has a value which is obtained by multiplying the deviation between the command current value and the value of the current which is actually supplied to the coils 42, 46 by the proportional gain as the feedback gain. When this feedback control is performed, it is required to maintain the current responsiveness at a high level when this feedback control is reflected on the current which is actually supplied to the coils 42, and to perform the control with stability by avoiding hunting and the like. Then, the proportional gain is set so as to satisfy these requirements.

Next, the mode of setting the proportional gain in the system used in the feedback control in FIG. 2 will be described. The transfer function of this system is described as follows.

$$P/(Ls+R+P) \quad (1)$$

A proportional gain P is set such that a high current responsiveness is obtained while avoiding hunting based on the transfer function described by this equation (1). In this case, the transfer function described by the equation (1) includes inductance L of the coils 42, 46. This inductance L changes based on the distance between the electromagnet 61 and the electromagnet 62 and the armature 28.

Hereafter, a relationship between the inductance L, and the distance between the electromagnet 61 or the electromagnet 62 and the armature 28 will be described using the electromagnet 62 and the armature 28 as examples, with reference to FIG. 3.

Figure 3:
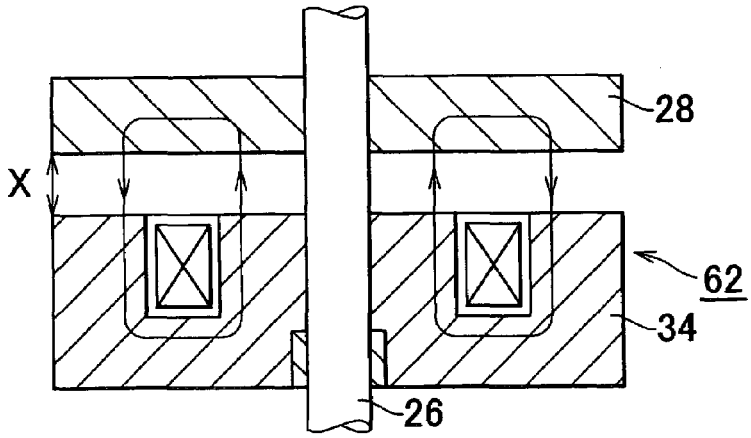
FIG. 3 is a sectional view for describing that coil inductance changes based on a distance between an electromagnet and an armature.

When an electromagnetic force is applied from the electromagnet 62 to the armature 28, a magnetic circuit shown in FIG. 3 is formed. Among the magnetic resistances in this magnetic circuit, a resistance η generated in a portion having a distance x between the electromagnet 62 and the armature 28 is described as follows. In this equation, μ denotes an air permeability and S denotes an area of the surface of the electromagnet 62 facing the armature 28.

$$\eta=2x/\mu S \quad (2)$$

Therefore, the magnetic resistance η T of the electromagnet 62, the armature 28, and the magnetic circuit between the electromagnet 62 and the armature 28 is described as follows. In the equation, K denotes the magnetic resistance of the electromagnet 62 and the magnetic resistance of the armature 28.

$$\eta T=K+2x/\mu S \quad (3)$$

Accordingly, the inductance L of the coil 46 is described as follows.

$$L=N^2/(K+2x/\mu S) \quad (4)$$

It can be understood from this equation (4) that the inductance L of the coil 46 is in inverse proportion to the distance x between the electromagnet 62 and the armature 28.

As described so far, the inductance of the coil 42 of the electromagnet 61 or the inductance of the coil 46 of the electromagnet 62 change based on the distance between the electromagnet 61 or the electromagnet 62 and the armature 28. Accordingly, when the feedback control is performed such that the value of the current is actually supplied to the coil 42 of the electromagnet 61 or the coil 46 of the electromagnet 62 becomes substantially equal to the command current value, the response mode of the current which is actually supplied to the coils 42, 26 with respect to the feedback control depends on the distance.

Therefore, according to the embodiment, the control mode of the feedback control is dynamically changed based on the distance between the electromagnet 61 or the electromagnet 62 and the armature 28. Namely, the proportional gain used in this feedback control is variably set based on the distance between the electromagnet 61 or the electromagnet 62 and the armature 28.

Accordingly, even when the inductance of the coil 42 of the electromagnet 61 or the coil 46 of the electromagnet 62 changes due to a change in the distance between the electromagnet 61 or the electromagnet 62 and the armature 28, it is possible to set an appropriate proportional gain based on the distance.

Figure 4:
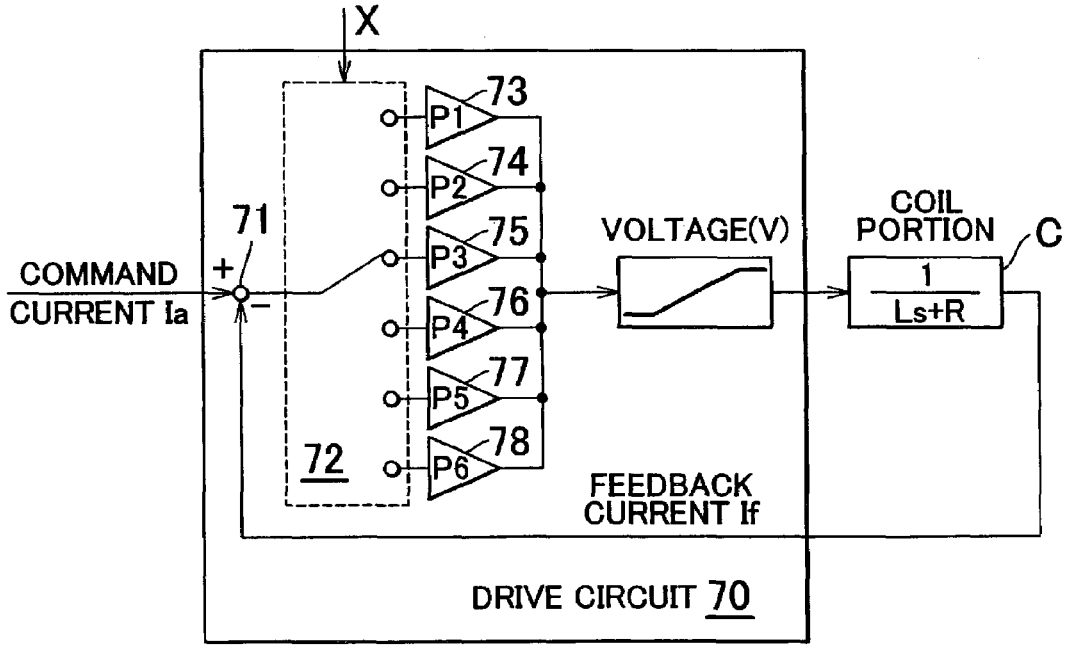
FIG. 4 is a block diagram showing a configuration of a drive circuit according to the embodiment.

FIG. 4 schematically shows a configuration of the drive circuit 70 through which feedback control is performed in the embodiment. In FIG. 4, a coil portion C shows the coil 42 of the electromagnet 61 and the coil 46 for electromagnet 62 as a transfer function thereof for convenience. In the drive circuit 70, a current corresponding to a deviation (Ia−If) between a current (a feedback current If) which is actually supplied to the coil portion C and a command current Ia which is supplied from the outside is output from an operational amplifier 71 to a switching portion 72. This switching portion 72 is a circuit for selectively outputting the current output from the operational amplifier 71 to one of multipliers 73 to 78 having a plurality (in this case, six) of proportional gains (P1, P2, . . . ). The switching portion 72 selects a proportional gain based on a value X detected by the displacement amount sensor 52, which corresponds to a detected value of the distance between the electromagnet 61 or the electromagnet 62 and the armature 28. Then, in the drive circuit 70, a voltage, which corresponds to a value obtained by multiplying the deviation between the feedback current If and the command current Ia by the selected proportional gain, is applied to the coil portion C.

Figure 5:
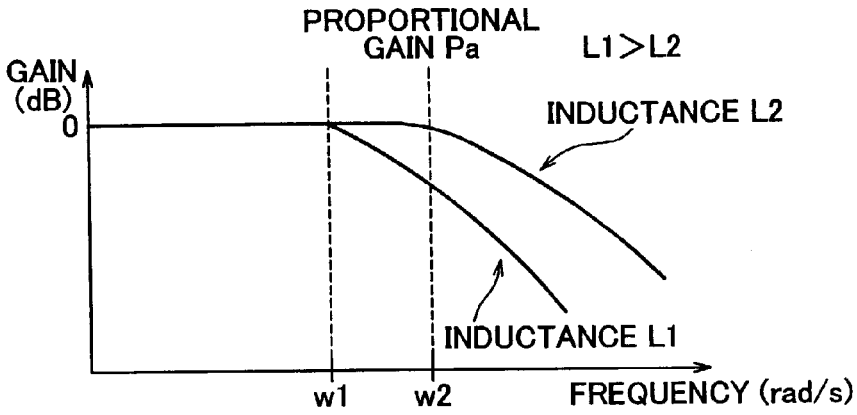
FIG. 5 is a diagram showing a relationship between coil inductance and a gain characteristic according to the embodiment when a proportional gain is constant.

Next, the mode of setting the proportional gain corresponding to the detected value of the distance between the electromagnet 61 or the electromagnet 62 and the armature 28 will be described. As described so far, the coil inductance of the electromagnet 61 or the electromagnet 62 depends on the distance between the electromagnet 61 or the electromagnet 62 and the armature 28. Accordingly, when the proportional gain is fixed, a Bode diagram of the transfer function shown in equation (1) is as shown in FIG. 5. Namely, when the distance is small (inductance L1), a cut-off frequency, which is a frequency when the gain of this transfer function decreases by a predetermined value (for example, 3 dB) or more, is lower than when the distance is large (inductance L2) (ω1<ω2). Since this cut-off frequency corresponds to the responsiveness of the control, which is described by the transfer function, it can be understood from this Bode diagram that when the distance is small (inductance L1), the frequency responsiveness is lower than when the distance is large (inductance L2).

Figure 6:
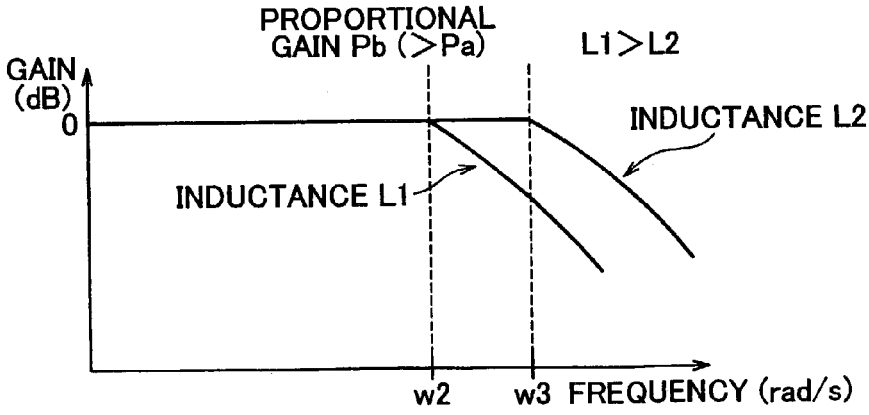
FIG. 6 is a diagram showing a relationship between the coil inductance and the gain characteristic according to the embodiment when the proportional gain is constant.

In the case where the proportional gain is controlled to be a value Pb which is larger than a value Pa in FIG. 5 so as to enhance the current responsiveness when the distance is small (inductance L1), that is, so as to increase the cut-off frequency, the Bode diagram of the transfer function in the equation (1) is as shown in FIG. 6. Namely, although it is possible to increase the cut-off frequency when the distance is small (inductance La) to ω2, the cut-off frequency when the distance is large (inductance L2) becomes ω3, which is larger than ω2.

In this case, when the distance is large (inductance L2), vibration (hunting) may occur in the current which is actually supplied to the electromagnet 61 or the electromagnet 62. This is due to a delay element of the circuit or the like in the drive circuit 70 which is electrically connected to the coils 42, 46 and which controls the amount of the current that is actually supplied to them, and noise from the outside.

Figure 7A:
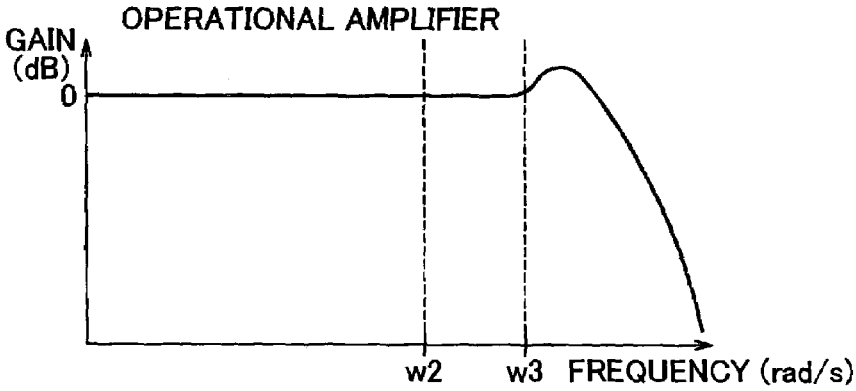
FIG. 7*a* is a diagram showing the gain characteristic according to the embodiment when a delay element of a circuit is added.

As a delay element, for example, there is a delay element due to resonance of the operational amplifier. FIG. 7*a* shows a Bode diagram of this operational amplifier 71. As shown in FIG. 7*a*, the transfer function of the operational amplifier 71 has a resonance component in the vicinity of the frequency ω3.

Figure 7B:
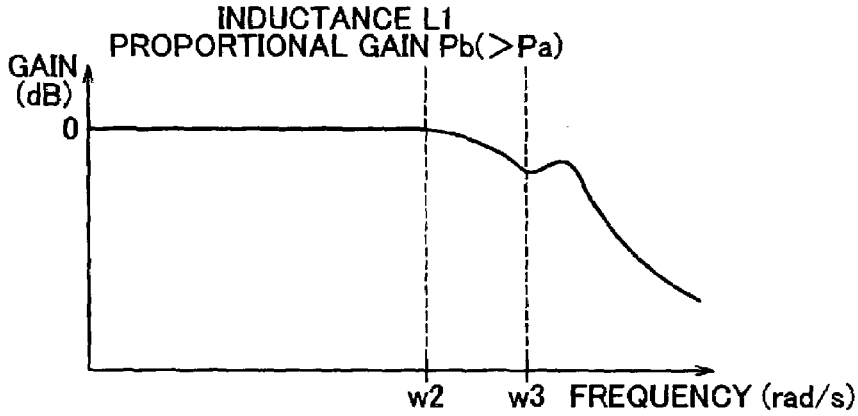
FIG. 7*b* is a diagram showing a gain characteristic in the embodiment when a distance between an electromagnet (for closing driving or for opening driving) and an armature is small.

FIG. 7*b* shows a Bode diagram of the transfer function of the circuit including the operational amplifier 71 and an element whose proportional gain is Pb in the transfer function in equation (1) when the distance is small (inductance L1). As shown in FIG. 7*b*, in this case, the cut-off frequency becomes substantially equal to the frequency ω2, as shown in FIG. 6. Also, the gain of the transfer function is sufficiently suppressed in the vicinity of the frequency ω3 at which resonance of the operational amplifier 71 occurs. Namely, in this case, it is possible to sufficiently suppress vibration (hunting) due to the resonance component of the operational amplifier 71, which occurs in the current that is actually supplied to the electromagnet 61 or the electromagnet 62.

Figure 7C:
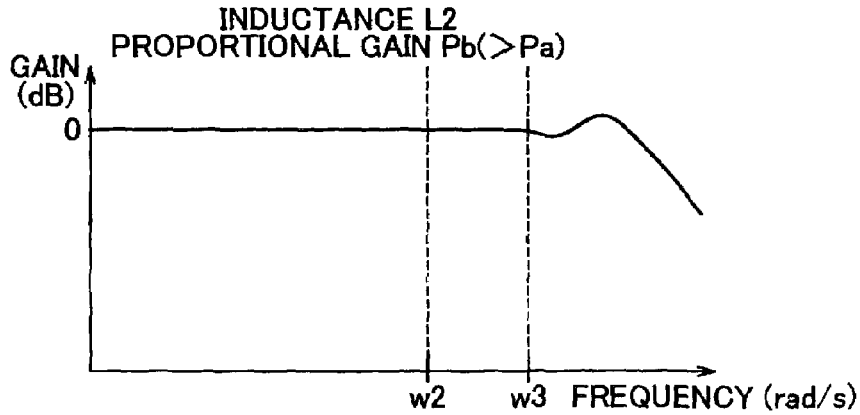
FIG. 7*c* is a diagram showing a gain characteristic in the embodiment when a distance between the electromagnet (for closing driving or for opening driving) and the armature is large.

Meanwhile, FIG. 7*c* shows a Bode diagram of the transfer function of the circuit including the operational amplifier 71 and an element whose proportional gain is Pb in the transfer function in the equation (1) when the distance is large (inductance L2). As shown in FIG. 7*c*, in this case, the cut-off frequency becomes substantially equal to the frequency ω3, as shown in FIG. 6. The gain of the transfer function is not sufficiently suppressed in the vicinity of the frequency ω3 at which resonance of the operational amplifier 71 occurs. Accordingly, in this case, vibration (hunting) due to the resonance component of the operational amplifier 71 occurs in the current which is actually supplied to the electromagnet 61 or the electromagnet 62.

For example, since the noise from the outside has a relatively high frequency, when the proportional gain is excessively large, it is impossible to sufficiently attenuate the gain of the transfer function even in the frequency area of this noise.

Further, for example, when the proportional gain is excessively large, the phase-delay of the transfer function of the coils 42, 46 and the transfer function of the circuit and the like in the drive circuit 70 exceeds 180 degrees. This also causes vibration (hunting) in the current which is actually supplied to the electromagnet 61 or the electromagnet 62.

As described so far, when the proportional gain becomes excessively large, vibration (hunting) occurs in the current which is actually supplied to the electromagnet 61 or the electromagnet 62 due to the delay element of the circuit and the like in the drive circuit 70 that is electrically connected to the coils 42, 46 and that controls the amount of current that is actually supplied to the coils, and noise from the outside.

Accordingly, in the embodiment, as the distance between the electromagnet 61 or the electromagnet 62 and the armature 28 becomes larger, the proportional gain is set to be a smaller value. Namely, as the distance between the electromagnet 61 or the electromagnet 62 and the armature 28 becomes larger, the voltage applied to the electromagnet 61 or the electromagnet 62 based on the deviation between the command current Ia and the feedback current If is set to be a smaller value. Accordingly, feedback control is performed using an appropriate proportional gain based on the distance.

More particularly, it is preferable that the proportional gain should be set to a value at which the current responsiveness is enhanced to the fullest extent within a range that vibration (hunting) can be sufficiently suppressed which occurs in the current which is actually supplied to the electromagnet 61 or the electromagnet 62. It is preferable that this current responsiveness should be set at least such that the period in which the value of the current which is actually supplied to the electromagnet 61 or the electromagnet 62 becomes substantially equal to the command current value is shorter than the period in which the command current is supplied to the drive circuit 70. Namely it is preferable that this current responsiveness should be set such that the period in which the value of the current which is actually supplied to the electromagnets becomes substantially equal to the command current value is shorter than the period in which the command current value is calculated by the electronic control unit 50.

In the embodiment, the cycle of performing the feedback control of the drive circuit 70 which is performed at each predetermined time is set to be shorter than the cycle of operating the central processor in the electronic control unit 50.

According to the embodiment described so far, the following effects can be obtained.

(1) The control mode of the feedback control is dynamically changed based on the distance between the electromagnet 61 or the electromagnet 62 and the armature 28. Namely, the proportional gain used in the feedback control is variably set based on the distance between the electromagnet 61 or the electromagnet 62 and the armature 28. Therefore, even when the coil inductance of the coil 42 of the electromagnet 61 or coil inductance of the coil 46 of the electromagnet 62 changes due to a change in the distance between the electromagnet 61 or the electromagnet 62 and the armature 28, it is possible to set an appropriate proportional gain based on the distance.

(2) As the distance between the electromagnet 61 or the electromagnet 62 and the armature 28 becomes larger, the proportional gain is set to a smaller value. Namely, as the distance between the electromagnet 61 or the electromagnet 62 and the armature 28 becomes larger, the voltage applied to the electromagnet 61 or the electromagnet 62 based on the deviation between the command current Ia and the feedback current If is set to be a smaller value. Accordingly, it is possible to perform feedback control using an appropriate proportional gain based on the distance.

(3) The execution period of the feedback of the drive circuit 70 is set to be shorter than the operation period of the central processor in the electronic control unit 50. Accordingly, even when the command current value is frequently changed, it is possible to appropriately perform the feedback control, which is performed such that the current that is actually supplied to the electromagnet 61 or the electromagnet 62 becomes substantially equal to the command current value. Also, it is possible to prevent a constraint on the operation frequency of the central processor from placed by the feedback control.

The embodiment may be modified as follows.

Figure 8:
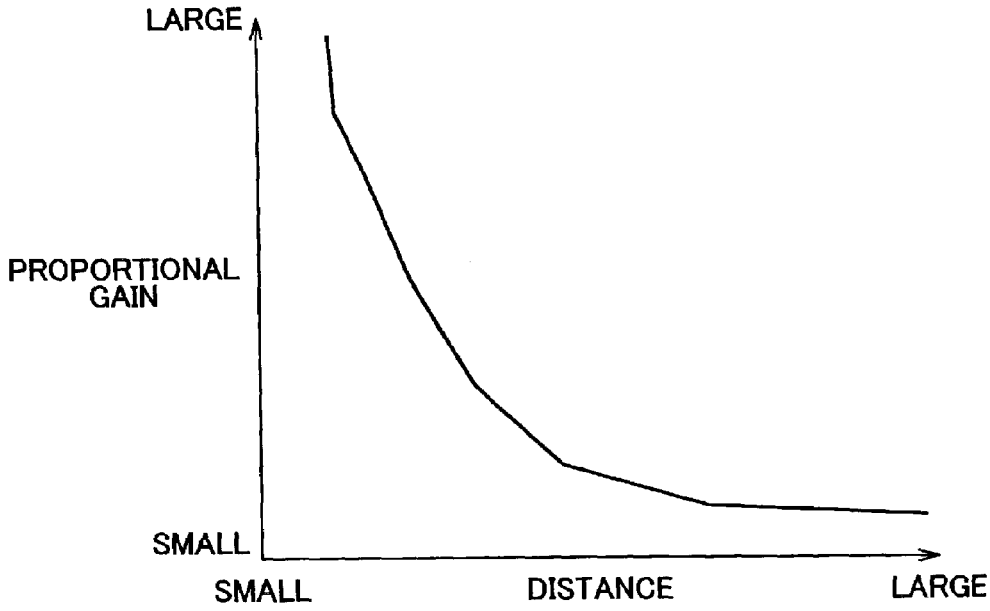
FIG. 8 is a diagram showing a relationship between the distance between the electromagnet and the armature, and the proportional gain in a modified example of the embodiment.

Instead of including a circuit corresponding to a plurality of proportional gains and switching a proportional gains in steps based on the distance between the electromagnet 61 or the electromagnet 62 and the armature 28, the proportional gain may be supplied so as to be interpolated by liner interpolation as shown in FIG. 8. Also, the interpolation may be a high order interpolation instead of the liner interpolation. Even in these cases, it is preferable to set the interpolation value such that the proportional gain becomes a smaller value as the distance between the electromagnet 61 or the electromagnet 62 and the armature 28 becomes larger.

In the embodiment, the command current value is supplied to the drive circuit as the value of the desired attracting current. However, the drive circuit is not limited to a drive circuit which is supplied with a current (a command current)

having a value of the desired attracting current and performs feedback control based on this value. For example, even when the drive circuit is a drive circuit which is supplied with a current corresponding to a certain shunt current of a value of the desired attracting current, it is possible to perform feedback control such that the value of the current which is actually supplied to the electromagnet becomes substantially equal to the value of the desired attracting current by using the deviation between the value of the current corresponding to a certain shunt current of a value of the desired attracting current and the value of the current corresponding to the certain shunt current of the current which is actually supplied to the electromagnet.

In the embodiment, P control is described as an example. However, control is not limited to this. For example, control may be PD control or PID control. It is preferable to add D (derivative) control to the P control, particularly when a circuit including a coil of an electromagnet and a circuit which performs the control of current supply to this coil is vibratory, for example, when the transfer function describing the coil of the electromagnet and the circuit which performs the control of current supply to this coil can be described as a second order system and the attenuation coefficient is small. When the transfer function can be described as a second order system, D gain is set so as to make the attenuation term large.

Further, feedback control may be feedback control in modern control instead of feedback control in classical control. In either case, it is possible to perform appropriate feedback control such that the value of the current which is actually supplied to the electromagnet becomes substantially equal to the value of the desired attracting current by variably setting the feedback gain used in the feedback control based on the distance between the electromagnet and the armature. In this case, the setting means for variably setting the feedback gain used in the feedback control based on the distance between the electromagnet and the armature may be formed of software means as well as hardware means.

Dynamic change of the control mode of the feedback control based on the distance between the electromagnet and the armature is not necessarily performed by variably setting the feedback gain. For example, a certain shunt current of the current which is actually supplied to the electromagnet may be used as a feedback current based on the distance between the electromagnet and the armature, and the mode of the shunt current may be changed based on the distance between the electromagnet and the armature. Thus, the mode of applying a voltage to the electromagnet is variably set such that the value of the current that is actually supplied to the electromagnet becomes substantially equal to the value of the desired attracting current, based on the distance between the electromagnet and the armature.

The control means for performing appropriate feedback control such that a value of the current which is actually supplied to the electromagnet becomes substantially equal to a value of the desired attracting current may not be the hardware means (the drive circuit 70) which is different from the electronic control unit for calculating the value of the desired attracting current. Namely, for example, the control means may be formed of a central processor in the electronic control unit and memory that stores a program performed by the central processor.

A desired attracting current (a command current) which is supplied to the control means is not limited to the current described in the embodiment. For example, the attracting current may not be supplied to the electromagnet 61 at the start time of opening the valve.

An electromagnetically driven valve is not limited to the electromagnetically driven valve including a pair of electromagnets as shown in FIG. 1. For example, the electromagnetically driven valve may include urging means for urging the movable portion to one of the displacement ends and an electromagnet for driving the movable portion to the other displacement ends.

An electromagnetically driven valve is not limited to a electromagnetically driven valve for opening or closing the valve element which functions as an intake valve and an exhaust valve of an internal combustion engine.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A control apparatus for an electromagnetically driven valve which is applied to an electromagnetically driven valve in which a movable portion including an armature and a valve element is driven using an electromagnetic force generated by an electromagnet, comprising:

a controller that performs feedback such that a value of a current that is actually supplied to the electromagnet becomes a value of a desired attracting current when displacing the movable portion by supplying the attracting current to the electromagnet, and that variably sets a feedback gain used in the feedback control of the attracting current based on a distance between the electromagnet and the armature.

2. The control apparatus for an electromagnetically driven valve according to claim 1, wherein the feedback gain includes a proportional gain which is set based on a deviation between the value of the current that is actually supplied to the electromagnet and the value of the desired attracting current, and the controller sets the proportional gain to a smaller value as the distance between the electromagnet and the armature becomes larger.

3. The control apparatus for an electromagnetically driven valve according to claim 1, wherein the controller performs feedback control such that the value of the current which is actually supplied to the electromagnet becomes a command current value by being supplied with the value of the desired attracting current as the command current value.

4. The control apparatus for an electromagnetically driven valve according to the claim 1, wherein the controller periodically calculates the value of the desired attracting current at each predetermined time based on the distance between the electromagnet and the armature, and sets a cycle of performing the feedback control to be shorter than a cycle of calculating the value of the attracting current.

5. A control apparatus for an electromagnetically driven valve which is applied to an electromagnetically driven valve in which a movable portion including an armature and a valve element is driven using an electromagnetic force generated by an electromagnet, comprising:

a controller that performs feedback such that a value of a current that is actually supplied to the electromagnet becomes a value of a desired attracting current when displacing the movable portion by applying a voltage to the electromagnet so as to supply an attracting current to the electromagnet, and that variably sets a feedback pain for applying a voltage to the electromagnet such that the value of the current that is actually supplied to the electromagnet comes close to the value of the desired attracting current, based on a distance between the electromagnet and the armature.

6. The control apparatus for an electromagnetically driven valve according to claim 5, wherein the controller applies a voltage to the electromagnet based on a deviation between the value of the current which is actually supplied to the electromagnet and the value of the desired attracting current, and sets the voltage applied to the electromagnet, which is set based on the deviation, to be a smaller value as the distance between the electromagnet and the armature becomes larger.

7. The control apparatus for an electromagnetically driven valve according to claim 5, wherein the controller performs feedback control such that the value of the current which is actually supplied to the electromagnet becomes a command current value by being supplied with the value of the desired attracting current as the command current value.

8. The control apparatus for an electromagnetically driven valve according to claim 5, wherein the controller periodically calculates the value of the desired attracting current at each predetermined time based on the distance between the electromagnet and the armature, and sets a cycle of performing the feedback control to be shorter than a cycle of calculating the value of the attracting current.

9. A control apparatus for an electromagnetically driven valve which is applied to an electromagnetically driven valve in which a movable portion including an armature and a valve element is driven using an electromagnetic force generated by an electromagnet, comprising:

a controller that performs feedback control such that a value of a current that is actually supplied to the electromagnet becomes a value of a desired attracting current when displacing the movable portion by supplying an attracting current to the electromagnet and that dynamically changes a feedback pain of the feedback control based on a distance between the electromagnet and the armature.

10. The control apparatus for an electromagnetically driven valve according to claim 9, wherein the controller performs feedback control such that the value which is actually supplied to the electromagnet becomes a command current value by being supplied with the value of the desired attracting current as the command current value.

11. The control apparatus for an electromagnetically driven valve according to claim 9, wherein the controller periodically calculates the value of the desired attracting current at each predetermined time based on the distance between the electromagnet and the armature, and sets a cycle of performing the feedback control to be shorter than a cycle of calculating the value of the attracting current.

12. A control method for an electromagnetically driven valve which is applied to an electromagnetically driven valve in which a movable portion including an armature and a valve element is driven using an electromagnetic force generated by an electromagnet, comprising the steps of:

performing feedback control such that a value of a current that is actually supplied to the electromagnet becomes a value of a desired attracting current when displacing the movable portion by supplying an attracting current to the electromagnet; and variably setting a feedback gain used in the feedback control of the attracting current based on a distance between the electromagnet and the armature.

13. The control method according to claim 12, wherein the feedback gain includes a proportional gain which is provided based on a deviation between the value of the current that is actually supplied to the electromagnet and the value of the desired attracting current, and further comprising the step of:

setting the proportional gain to be a smaller value as the distance between the electromagnet and the armature becomes larger.

14. The control method according to claim 12, further comprising the step of:

performing feedback control such that the value of the current which is actually supplied to the electromagnet becomes a command current value by being supplied with the value of the desired attracting current as the command current value.

15. The control method according to claim 12, further comprising the steps of:

periodically calculating the value of the desired attracting current at each predetermined time based on the distance between the electromagnet and the armature; and setting a cycle of performing the feedback control to be shorter than a cycle of calculating the value of the attracting current.

16. A control method for an electromagnetically driven valve which is applied to an electromagnetically driven valve in which a movable portion including an armature and a valve element is driven using an electromagnetic force generated by an electromagnet, comprising the steps of:

performing feedback control such that a value of a current that is actually supplied to the electromagnet becomes a value of a desired attracting current when displacing the movable portion by applying a voltage to the electromagnet so as to supply an attracting current; and variably setting a feedback pain for applying a voltage to the electromagnet such that the value of the current that is actually supplied to the electromagnet comes close to the value of the desired attracting current, based on a distance between the electromagnet and the armature.

17. The control method according to claim 16, further comprising the steps of:

applying a voltage to the electromagnet based on a deviation between the value of the current which is actually supplied to the electromagnet and the value of the desired attracting current; and setting a voltage which is applied to the electromagnet, that is determined based on the deviation, to be a smaller value as the distance between the electromagnet and the armature becomes larger.

18. The control apparatus according to claim 16, further comprising the step of:

performing feedback control such that the value of the current which is actually supplied to the electromagnet becomes a command current value by being supplied with the value of the desired attracting current as the command current value.

19. The control method according to claim 16, further comprising the steps of:

periodically calculating the value of the desired attracting current at each predetermined time based on the distance between the electromagnet and the armature; and setting a cycle of performing the feedback control to be shorter than a cycle of calculating the value of the attracting current.

20. A control method of an electromagnetically driven valve which is applied to an electromagnetically driven valve in which a movable portion including an armature and a valve element is driven using an electromagnetic force generated by an electromagnet, comprising the steps of:

performing feedback control such that a value of a current that is actually supplied to the electromagnet becomes a value of a desired attracting current when displacing the movable portion by supplying an attracting current to the electromagnet; and dynamically changing a feedback gain for the feedback control based on a distance between the electromagnet and the armature.

21. The control method according to claim 20, further comprising the step of:

performing feedback control such that the value of the current which is actually supplied to the electromagnet becomes a command current value by being supplied with the value of the desired attracting current as the command current value.

22. The control method according to claim 20, further comprising the steps of:

periodically calculating the value of the desired attracting current at each predetermined time based on the distance between the electromagnet and the armature; and setting a cycle of performing the feedback control to be shorter than a cycle of calculating the value of the attracting current.

23. The control apparatus for an electromagnetically driven valve according to claim 5, wherein the feedback gain includes a proportional gain which is set based on a deviation between the value of the current that is actually supplied to the electromagnet and the value of the desired attracting current, and the controller sets the proportional gain to a smaller value as the distance between the electromagnet and the armature becomes larger.

24. The control method according to claim 16, wherein the feedback gain includes a proportional gain which is provided based on a deviation between the value of the current that is actually supplied to the electromagnet and the value of the desired attracting current, and further comprising the step of:

setting the proportional gain to be a smaller value as the distance between the electromagnet and the armature becomes larger.

25. The control method according to claim 20, wherein the feedback gain includes a proportional gain which is provided based on a deviation between the value of the current that is actually supplied to the electromagnet and the value of the desired attracting current, and further comprising the step of:

setting the proportional gain to be a smaller value as the distance between the electromagnet and the armature becomes larger.

* * * * *

UNITED STATES PATENT AND TRADEMARK OFFICE

CERTIFICATE OF CORRECTION

PATENT NO. : 7,054,128 B2
APPLICATION NO. : 10/449017
DATED : May 30, 2006
INVENTOR(S) : Fuwa It is certified that error appears in the above-identified patent and that said Letters Patent is hereby corrected as shown below:

| Column | Line | |
|---|---|---|
| 15 | 2-3 | Change “feedback pain” to--feedback gain--. |
| 15 | 41 | Change “feedback pain” to--feedback gain--. |
| 16 | 39 | Change “feedback pain” to--feedback gain--. |

Signed and Sealed this

Twenty-fourth Day of October, 2006

JON W. DUDAS
*Director of the United States Patent and Trademark Office*